US005415563A

United States Patent [19]

Shan et al.

[11] Patent Number: 5,415,563

[45] Date of Patent: May 16, 1995

[54] WIRE CONNECTING APPARATUS AND TERMINAL THEREFOR

[75] Inventors: Laval C. L. Shan, Strurens Valley; Paul L. Rishworth, Bellevue East, both of South Africa

[73] Assignee: Molex Incorporated, Lisle, Ill.

[21] Appl. No.: 268,416

[22] Filed: Jun. 30, 1994

[30] Foreign Application Priority Data

Jul. 15, 1993 [ZA] South Africa ..... 93/5106

[51] Int. Cl.[6] ..... H01R 9/12

[52] U.S. Cl. ..... 439/439

[58] Field of Search ..... 439/439, 722, 437, 729

[56] References Cited

U.S. PATENT DOCUMENTS

| | | | |
|---|---|---|---|
| 2,773,248 | 12/1956 | Smith | 439/439 |
| 3,019,406 | 1/1962 | Slater | 439/439 |
| 3,393,397 | 7/1968 | Manichl | 439/439 |
| 3,585,570 | 6/1971 | Jans | 439/439 |
| 3,665,373 | 5/1972 | Voglesonger | 439/439 |
| 3,704,438 | 11/1972 | Boone | 439/439 |
| 3,967,873 | 7/1976 | Schumacher | 439/441 |
| 4,056,299 | 11/1977 | Paige | 439/439 |
| 4,354,722 | 10/1982 | Morel | 439/437 X |

FOREIGN PATENT DOCUMENTS

| | | | |
|---|---|---|---|
| 2049307 | 12/1980 | United Kingdom | 439/439 |

*Primary Examiner*—William Briggs
*Attorney, Agent, or Firm*—Stacey E. Caldwell

[57] ABSTRACT

This invention relates to a wire-connecting apparatus which comprises an insulating housing and cover, and at least one terminal mounted in the housing wherein each terminal comprises a strip of electrically conductive sheet material having spaced terminal slit arrangements formed therein. Each slit arrangement defines a plurality of tongues adapted to grip a wire or pin inserted between them. Wire-receiving holes extend through the wall of the housing, and pin-receiving holes extend through the cover with each wire and pin-receiving hole being in register with a terminal slit arrangement.

8 Claims, 1 Drawing Sheet

WIRE CONNECTING APPARATUS AND TERMINAL THEREFOR

FIELD OF THE INVENTION

This invention relates to a wire-connecting apparatus for connecting one wire to another, or for making an electrical connection between an electronic component and a wire. The invention additionally extends to a terminal for use in such arrangements.

BACKGROUND OF THE INVENTION

Wire-connecting arrangements in the form of connector assemblies for electrically joining two wires or for connecting the pins of an electrical component to wires are known. These arrangements generally consist of a housing having a pair of electrical terminals electrically coupled to one another, and the wires and/or the component pins are connected to the terminals from outside of the housing. In many cases, the individual terminals of each pair are separate and are connected together on the inside of the housing by electrically conductive clips or wires, which are themselves soldered or screw-clamped to the individual terminals. In a number of arrangements, one or both terminals project outside the housing. Therefore, the soldering and screw-clamping of the wires and/or pins to the terminals, both on the inside and outside of the housing, not only add to the cost of manufacturing the assembly, but may result in dry soldered or poorly clamped electrically intermittent connections. Additionally, the exposed uninsulated portions of the terminals on the outside of the housing are electrically hazardous.

SUMMARY OF THE INVENTION

A wire-connecting apparatus according to the invention comprises a connector assembly having a housing which is made from an electrically insulating material, a cover and at least one terminal mounted in the housing. Each terminal comprises a single strip of electrically conductive sheet metal material having two sets of spaced terminal slit arrangements which each define a plurality of tongues adapted to grip a wire or pin pressed between them. The housing and cover both include wire or pin-receiving holes, each hole being in register with a terminal slit arrangement.

Each terminal is generally L-shaped and a terminal slit arrangement is located in each separate planar portion thereof. Preferably, the form defining the L-shape of the terminal is generally coincident with the centerline of the terminal strip. The tongues defined by the terminal slit arrangements in each terminal may be formed out of alignment from one another to prevent wires gripped by the tongues of the terminal slits within a single terminal from interfering with one another.

The electrically insulating housing is generally rectangular and includes integrally formed wall formations on the inner surfaces of two walls of the housing which locate and hold the terminals within the housing. Each terminal-locating wall formation may include inwardly extending ramps against which the wire-gripping tongues (defined by the terminal slit arrangements) bear, to bias the tongues out of the general plane of the terminal strip in the direction of insertion of a wire inserted between them.

In one form of the invention, the outside surface of one of the housing walls and of the cover includes outwardly extending wire or pin-receiving projections for receiving the lead of an electrical component or the stripped end of a wire. The wires or pins extend through the spaced wire or pin-receiving holes and are subsequently gripped by the wire-gripping tongues of the terminal slit arrangements, which slits are in register with the spaced holes.

According to another aspect of the invention, an electrical terminal for use in a wire-connecting apparatus comprises a terminal strip of electrically conductive material. Each terminal includes two sets of spaced terminal slit arrangements which each define a pair of catch tongues adapted to grip a wire or pin inserted between them. The strip is generally L-shaped and one terminal slit arrangement is located in each separate planar portion of the strip, on opposite sides of the form. The catch tongues defined by the terminal slit arrangements in each terminal may be located out of alignment with respect to one another to prevent individual wires from interfering with one another upon insertion into the separate catch tongues.

BRIEF DESCRIPTION OF THE DRAWINGS

The invention is now described by way of example only with reference to the drawings in which.

DETAILED DESCRIPTION OF THE PREFERRED EMBODIMENT

Figure 1:
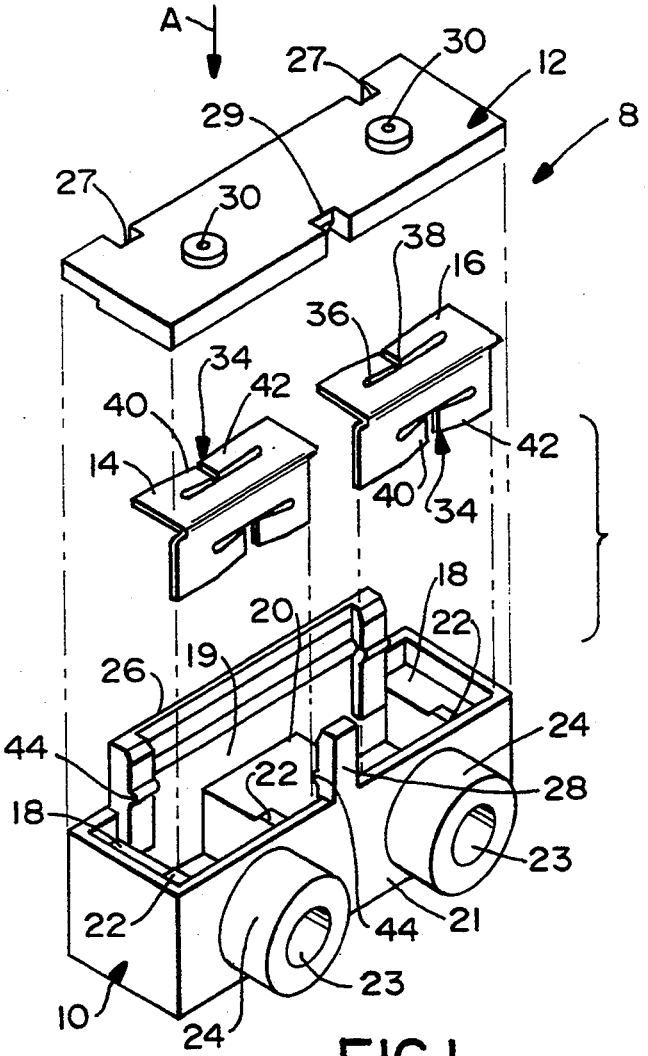
FIG. 1 is an exploded isometric view of a wire-connecting apparatus according to the invention including a housing, a cover and two wire-connecting terminals.

FIG. 1 illustrates a wire-connecting apparatus for connecting the pins of an electronic component, not shown, to two conductors of an underlying electrical circuit.

The wire-connecting apparatus of FIG. 1 comprises a connector assembly 8 having a base housing 10, a closure or cover 12 for the base housing, and two wire-connecting terminals 14 and 16. Both the base housing 10 and the cover 12 are molded from a suitable heat resistant plastic material.

The base housing 10 is generally box-shaped, as shown in FIG. 1, and includes two integrally formed outer wall formations 18 and a single integrally formed central wall formation 20 which extend from the rear wall 19 of the housing cavity, as viewed in FIG. 1, towards a front wall 21, to be partially spaced from the front wall (FIG. 3), to provide locating slots for the terminals. The forward upper edge of each outer wall formation 18 includes a single upstanding support 22, and the central wall formation 20 includes two upstanding supports 22, one at each end of its front edge (only one can be seen in FIG. 1). The upper surface of the supports 22 are spaced from the underside of the cover 12 by the thickness of the terminal material when the cover is in position on the base housing 10, thus providing a support surface for the horizontal portion of each terminal upon assembly of the apparatus.

Figure 3:
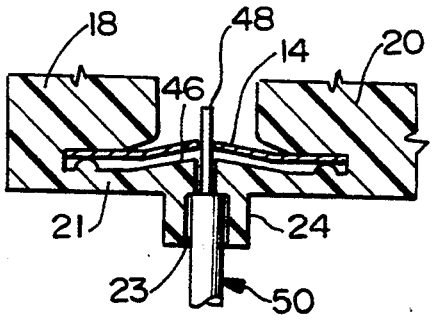
FIG. 3 is a sectioned plan view of a fragment of the front wall of the assembled apparatus of FIG. 1.

Looking now to FIG. 3 in conjunction with FIG. 1, front wall 21 of base housing 10 has wire-receiving holes 23, located between outer wall formations 18 and central wall formation 20. Sockets 24 surround the wire-receiving holes on the outside front wall of the housing and project outwardly therefrom. The wire-receiving holes extend into and through the front wall of the base housing and become the coaxial, smaller diameter wire-receiving holes on the inside front wall of the base housing.

Looking still to FIG. 1, the base housing further includes upstanding rear and front latch formations 26 and 28, respectively, which project upwardly above the cover 12, when the cover is positioned on base housing 10.

Cover 12 includes edge recesses 27 and 29 for accommodating the formations 26 and 28 on base housing 10 and for providing a latching surface therefor. The latch formations 26 and 28 include inwardly projecting latch hooks 44 which resiliently engage the edge recesses of cover 12 to hold the closure firmly onto base housing 10. The cover further includes two pin-receiving projections surrounding two spaced pin-receiving holes 30 for receiving two wire pins of an electronic component which may be positioned on the cover in use.

Figure 2:
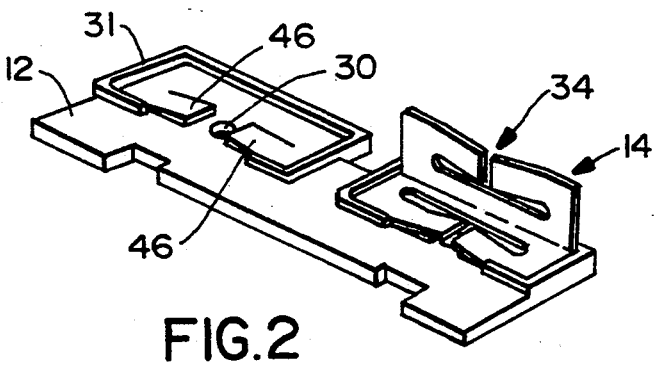
FIG. 2 is a perspective view showing the underside of the housing cover of the apparatus of FIG. 1.

The underside of the cover, as seen in FIG. 2, carries two downwardly projecting terminal support structures 31 in which the horizontal portions of terminals 14 and 16 are located and held (only one terminal is shown for clarity in FIG. 2). Two ramp formations (46) are situated within the area enclosed by each terminal support structure 31 on opposite sides of each hole 30, described in more detail below.

Figure 4:
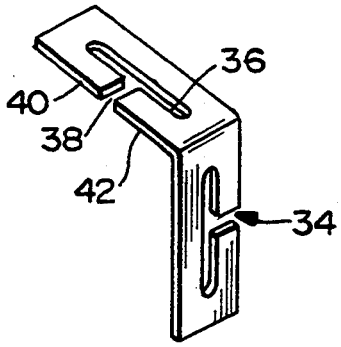
FIGS. 4 and 5 are two further embodiments of the wire-connecting terminals of the invention.

Each wire-connecting terminal 14 and 16 is generally L-shaped, with each planar portion thereof including a wire catch terminal slit arrangement indicated generally at 34. Each terminal is formed from suitable electrically conductive sheet material which has an adequate hardness and resilience for the purpose of the terminals. A suitable material from which the terminals may be made is phosphor bronze. The terminal slit arrangements, in each embodiment of the invention, are provided by a first cut or slot 36 contained within each planar portion of the terminal and a second cut 38 which extends generally perpendicular to the first cut 36 from the center thereof to the edge of the terminal or to a second slot 36 (FIG. 5) to provide catch tongues 40 and 42 on each side of cut 38. Tongues 40 and 42 may be formed slightly inwardly as shown in FIGS. 1, 2 and 4, or they may be left in the general plane of the portion of the terminal in which they are located, as shown in FIG. 4. As can be seen in FIGS. 1 and 2, the cuts 38 of the wire catch terminal slits may be formed out of alignment with respect to one another so that a first wire or pin inserted into the terminal will not interfere with a second wire or pin inserted into the other planar section of the terminal.

To assemble the connector assembly of FIG. 1, the horizontal portions of terminals 14 and 16 are located in terminal support structures 31 of cover 12 and the cover is then pressed downwardly, in the direction of arrow A (FIG. 1), until the vertical edge portions of the terminals are firmly located in the slots between formations 18 and 20 on the inner surface of the front wall 21, as shown in FIG. 3, and until the underside of the horizontal outer edge portions of the terminals supported in cover 12 are bearing on supports 22. When the terminals are so positioned, second cuts 38 of wire catch terminal arrangement 34 on the vertical portions of the terminals are in register with wire-receiving holes 23 in front wall 21 of the base housing, and second cuts 38 of wire catch terminal slit arrangement 34 on the horizontal portions of the terminals are in register with spaced pin-receiving holes 30 in cover 12. The cover 12 may now be pressed down onto the base housing with the upwardly projecting latch formations 26 and 28 of the base housing being located and held by the latching surfaces of edge recesses 27 and 29 of cover 12. Although not shown in the drawings, base housing 10 may include downwardly projecting flanges or pegs or the like to secure the assembly in place in a fitting or fixture.

In one application of the invention, the apparatus is used in a fluorescent lighting fixture and a generally rectangular electronic starter unit (not shown) is positioned on the cover of the connector assembly and includes two downwardly directed and parallel connector pins which are pressed through spaced pin-receiving holes 30 in cover 12 until the starter is located firmly between latch formations 26 and 28. After the starter pins are inserted through holes 30 they enter cuts 38 of wire catch slits 34 of the terminals and press tongues 40 and 42 of the wire catch slits inwardly. The distance separating the edges of cuts 38 in the wire catch slit terminal arrangement is initially smaller than the diameter of the pins so that the outer edges of the tongues are biased, by the resilience of the terminal material, into firm gripping engagement with the pins to minimize removal of the starter unit from the connector assembly. The ramp formations 46 on the underside of cover 12 (FIG. 2), predispose catch tongues 40 and 42 inwardly to lock or "trap" the pin in terminal slit arrangements 34 and therefore interfere with the withdrawal of the pins (and the entire starter unit) from the terminals.

Two conductors of the underlying lighting circuit are then connected to the starter pins by way of connector assembly 8. Looking again to FIG. 3, the stripped ends 48 of electrical conductors 50 are inserted through sockets 24, through the wire-receiving holes in the front wall of the base housing, and through cuts 38 in the vertical portions of the terminals to bend catch tongues 40 and 42 rearwardly (in the direction of insertion of the wires) into firm gripping engagement with said stripped ends, as shown in FIG. 3. As described above with respect to the starter pins, the gripping effect of the tongue edges against the stripped wires, and the biasing effect by ramp formations 46 of the tongues in the wire insertion direction, prevents unintentional withdrawal of the wires from sockets 24. The insulation at the stripped ends of the wires is frictionally held in socket formations 24 in the larger diameter portion of the wire-receiving holes as shown in FIG. 3.

Figure 5:
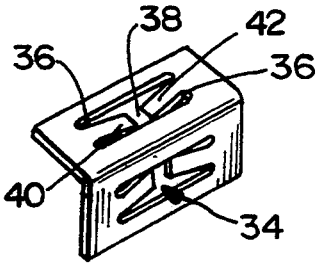

FIGS. 4 and 5 illustrate two additional embodiments of the many possible variations of terminals 14 and 16. In FIGS. 4 and 5 like reference numbers denote like components to those of the terminals 14 and 16 of FIG. 1. In FIG. 4, cuts 38 of the wire catch terminal slit arrangements are located on opposite sides of the longitudinal centerline of the strip to be out of alignment with respect to one another so that a wire which is engaged with and projects from the catch tongues on one planar section of the terminal will not interfere with a second wire or pin which projects from the terminal slit on the other planar section of the strip.

The housing in which the terminals of the invention are used is not necessarily only that illustrated in FIG. 1 and could be any housing used for any purpose in which the wire-connecting terminals of the invention find use.

The foregoing are descriptions of currently preferred embodiments of the terminals and a housing of the invention which are given here by way of example only. The invention is not to be taken as limited to any of the specific features as described and illustrated but comprehends all variations which lie within the scope of the appended claims.

We claim:

1. A wire-connecting apparatus comprising:

a dielectric base housing, and at least one electrically conductive terminal mounted within the housing, wherein each terminal includes a generally L-shaped terminal strip defined by two generally transverse planar portions, each planar portion having a terminal slit arrangement defining a set of spaced tongues adapted to grip one of a wire and pin inserted thereinto, and wherein the base housing includes a wire-receiving hole in register with the terminal slit arrangement on one of the planar portions of the terminal strip.

2. A wire-connecting apparatus as set forth in claim 1 further comprising a cover for mounting on the housing having a pin-receiving hole in register with the terminal slit arrangement on the other of the planar portions of the terminal strip.

3. A wire-connecting apparatus as set forth in claim 2 wherein the base housing is generally box-shaped and includes integrally formed wall formations which locate and hold the terminal in position within the housing.

4. A wire-connecting apparatus as set forth in claim 2 wherein the cover further comprises a terminal support structure on an inside surface thereof for holding the other of the planar portions of the terminal, and an inwardly extending ramp within the area defined by the terminal support structure adjacent the pin-receiving hole and against which the tongues of the terminal slit arrangement bear to predispose the tongues out of the general plane of the terminal strip.

5. A wire-connecting apparatus as set forth in claim 3 wherein an outer wall the base housing includes an outwardly extending wire-receiving socket for guiding the wire into the wire-receiving hole and into gripping engagement by the tongues of the terminal slit arrangement.

6. An electrical terminal for use in a wire-connecting apparatus comprising:

a generally L-shaped terminal strip of electrically conductive sheet material defined by two generally transverse planar portions, each planar portion including a terminal slit arrangement which defines a set of tongues adapted to grip one of a wire and a pin inserted thereinto.

7. An electrical terminal as set forth in claim 6 wherein each terminal slit arrangement includes a first generally elongated slot and a second slot which extends generally perpendicular to the first slot and defines the wire-gripping tongues of the terminal.

8. An electrical terminal as set forth in claim 7 wherein the second slot of the terminal slit arrangement on one planar portion of the terminal strip is formed out of alignment with respect to the second slot of the terminal slit arrangement on the other of the planar portion of the terminal strip, whereby a first one of a wire and pin inserted into the second slot of the terminal slit arrangement on the one planar portion of the terminal strip will not interfere with a second one of a wire and pin inserted into the second slot of the terminal slit arrangement on the other of the planar portion of the terminal strip.

* * * * *